United States Patent [19]

Handler

[11] Patent Number: 4,763,798

[45] Date of Patent: Aug. 16, 1988

[54] STACKING, PIVOTING, WALL STORAGE UNIT

[75] Inventor: Michael D. Handler, Norwalk, Conn.

[73] Assignee: Actief N.V., Curacao, Netherlands

[21] Appl. No.: 893,385

[22] Filed: Aug. 5, 1986

[51] Int. Cl.[4] ..... A47F 5/08

[52] U.S. Cl. ..... 211/88; 403/24; 403/377

[58] Field of Search ..... 211/88, 81, 89, 86, 211/90, 183; 206/503; 24/204, 205.2, 205.3, 442, 443, 444, 456, DIG. 11; 49/463, 465; 312/263; 52/71, 70, 234, DIG. 13

[56] References Cited

U.S. PATENT DOCUMENTS

| | | | |
|---|---|---|---|
| 739,471 | 9/1903 | Allison | 211/86 X |
| 1,638,073 | 8/1927 | Van Heusen | 24/204 |
| 2,728,480 | 12/1955 | Close | 312/263 |
| 3,176,364 | 4/1965 | Dritz | 24/204 |
| 3,192,306 | 6/1965 | Skonnord | 312/213 |
| 3,251,399 | 5/1966 | Grossman | 160/180 |
| 3,413,656 | 12/1968 | Vogliano et al. | 2/2 |
| 3,475,810 | 11/1969 | Mates | 24/204 |
| 3,491,486 | 1/1970 | Caruth | 49/463 |
| 3,512,318 | 5/1970 | Turner | 52/100 |
| 3,668,808 | 6/1972 | Perina | 49/465 |
| 3,696,472 | 10/1972 | Perina et al. | 24/205 |
| 3,745,709 | 7/1973 | Perina | 49/465 |
| 3,908,830 | 9/1975 | Skrzelowski | 211/90 X |
| 4,165,555 | 8/1979 | Boxer et al. | 24/204 |
| 4,271,566 | 8/1979 | Perina | 24/294 |
| 4,493,174 | 1/1985 | Arens | 52/243 |

*Primary Examiner*—Ramon S. Britts
*Assistant Examiner*—Sarah A. Lechok Eley
*Attorney, Agent, or Firm*—Hayes, Davis & Soloway

[57] ABSTRACT

A stacking, pivoting, wall storage unit with removable storage containers, shelves, and the like comprising a vertical mounting member adapted for mounting to a wall or the like. A vertical connecting member is hingedly carried by the mounting member for pivoting about a vertical axis through at least 90°. The connecting member includes a plurality of vertically disposed shear trap channels each having a pair of opposed planar members with the hook portion of hook and loop fastening material on inward facing surfaces. The planar members are adapted to releasably receive the loop portion of hook and loop fastening material therebetween and maintain it in shear. A plurality of stacking members each having a vertical fin member extending therefrom and having the loop portion of hook and loop fastening material on parallel outward facing surfaces of the outer edge thereof are provided for releasable attachment to the vertical connecting member by fastening the fins in the shear trap channels.

11 Claims, 4 Drawing Sheets

STACKING, PIVOTING, WALL STORAGE UNIT

BACKGROUND OF THE INVENTION

The present invention relates to wall units comprising shelves, drawers, and the like, and, more particularly to a stacking, pivoting, wall storage unit with removable storage containers, shelves, and the like, comprising a vertical mounting member adapted for mounting to a wall, floor, ceiling or the like; a vertical connecting member hingedly carried by the mounting member for pivoting about a vertical axis through at least 90°, the connecting member including a vertically disposed shear trap channel having a pair of opposed planar members with the hook portion of hook and loop fastening material on inward facing surfaces, the planar members being adapted to releasably receive the loop portion of hook and loop fastening material therebetween and maintain it in shear; and, a plurality of stacking members each having a vertical fin member extending therefrom and having the loop portion of hook and loop fastening material on parallel outward facing surfaces of the outer edge thereof whereby the stacking members can be releasably attached in stacked fashion to the vertical connecting member by fastening the fins in the shear trap channel and can be individually rotated about the vertical axis for access to individual members.

Stacking units of drawers, trays, shelves, and the like are known in the art. Some are adapted to sit on floors or tables while larger versions are adapted to mount to walls and the like. The present invention is primarily directed to the latter units which, typically in the prior art, have been constructed of elaborate wood or metal structures having hinged portions carrying the components to be pivoted. Where removability of the component was desired, the components have typically been provided with a pin projection adapted to removably fit into a socket on the structure provided therefor. Where adaptability to various sizes was required, such as on the interior of a clothes closet for organization purposes, such prior art framed units were not very adaptable and the framework thereof tended to use up much of the valuable closet space.

Wherefore, it is the object of the present invention to provide a stacking, pivoting, wall storage unit with removable storage containers, shelves, and the like, which is of simple and lightweight construction using easy to clean materials such as plastics and which is easily adaptable to varying size requirements while not occupying much space for the supporting elements thereof.

SUMMARY

The foregoing object has been achieved in a stacking, pivoting, wall storage unit with removable storage containers, shelves, and the like, comprising a vertical mounting member adapted for mounting to a wall or the like. A vertical connecting member is hingedly carried by the mounting member for pivoting about a vertical axis through at least 90° and includes a vertically disposed shear trap channel having a pair of opposed planar members with the hook portion of the hook and loop fastening material on inward facing surfaces. The planar members are adapted to releasably receive the loop portion of hook and loop fastening material therebetween and maintain it in shear. For attachment thereto, there are a plurality of stacking members each having a vertical fin member extending therefrom and having the loop portion of hook and loop fastening material on parallel outward facing surfaces of the outer edge thereof whereby the stacking members can be releasably attached in stacked fashion to the vertical connecting member by fastening the fins in the shear trap channel and can be individually rotated about the vertical axis for access to individual members.

DESCRIPTION OF THE PREFERRED EMBODIMENT

In my co-pending patent application entitled SHEAR TRAP HOOK AND LOOP FASTENING SYSTEM, filed on Oct. 5, 1986 as U.S. patent application Ser. No. 893,390 and assigned to the common assignee of this application, I described an improvement to hook and loop fastening systems wherein a shear trap channel is employed to use the hook and loop fastening material "in shear" to provide a high holding strength. Other copending applications filed on Oct. 5, 1986 are U.S. patent application Ser. Nos. 893,382, 893,383, 893,384, 893,586 and 893,388, each of which has been assigned to the common assignee of this application. The shear trap channel, however, allows the hook and loop fastening materials to be disengaged easily when necessary. The teachings of that co-pending application are hereby incorporated herein by reference and, accordingly, only a cursory description of the basic invention as incorporated into this invention will be provided.

Figure 1:
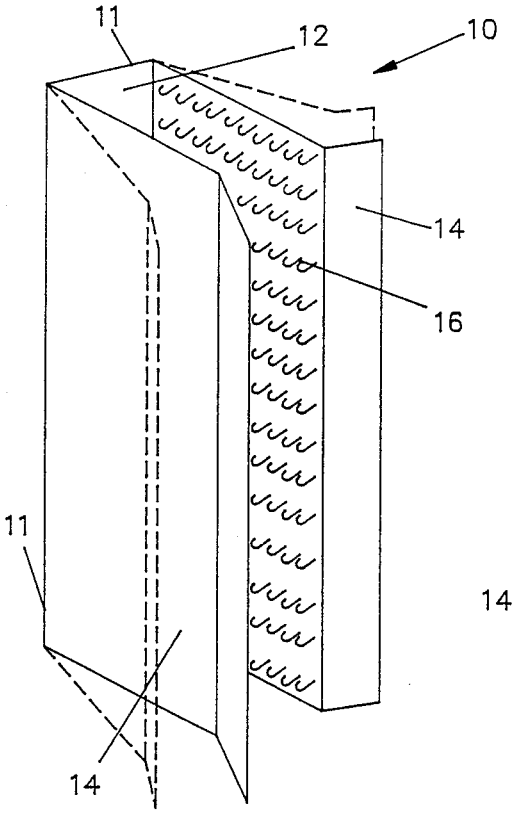
FIG. 1 is a simplified perspective view of one embodiment of Applicant's invention of a shear trap channel as employed in the present invention.
Figure 2:
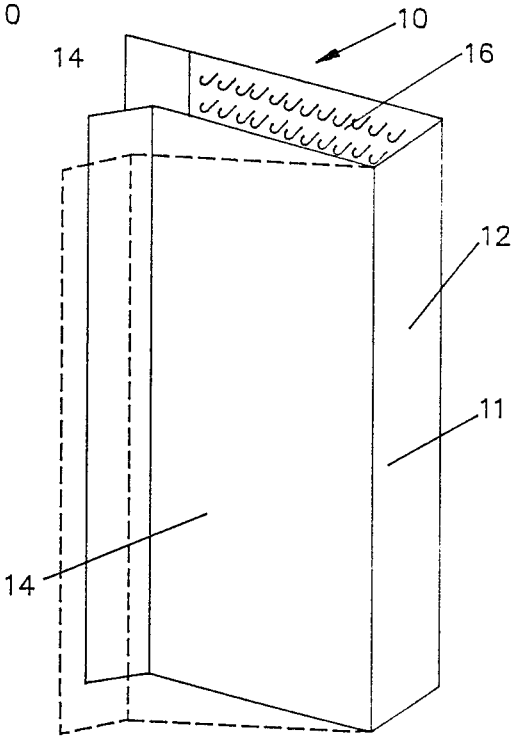
FIG. 2 is a simplified perspective view of a second embodiment of Applicant's invention of a shear trap channel as employed in the present invention.

Turning briefly to FIGS. 1 and 2, the shear trap channels of my above-referenced co-pending application are shown in simplified form. In both cases, the shear trap channel is indicated as 10 and comprises a back portion 12 from which two parallel, spaced side portions 14 extend. In the preferred embodiment, the trap channels 10 are made of resilient plastic and the hinges described within relation thereto are so-called "living hinges" formed into the plastic material. In the embodiment of FIG. 1, both side portions 14 are hingedly attached to the back portion 12 such that both can swing outward, as indicated by the dotted ghost lines, for release of the hook and loop fastening materials employed therewith. Attachment of something to be fastened therewith is made to the back portion. In the embodiment of FIG. 2, only the one side portion 14 is hingedly attached to the back, as indicated by the single dotted ghost line. Attachment to this embodiment is made to either the back portion 12 or the other side portion 14. In the preferred embodiment the facing inner surfaces of the side portions 14 have the hook porton 16 of hook and loop type fastening material thereon. The living hinges are indicated in both cases as 11. Thus, if a planar member (not shown) having the loop material on outward facing parallel surfaces is inserted between the side portions 14, the planar member will be maintained therein with the hook and loop material operating "in shear". By swinging the side portions 14 outward, however, the hook and loop materials can be progressively released to allow the planar member to be withdrawn.

Figure 3:
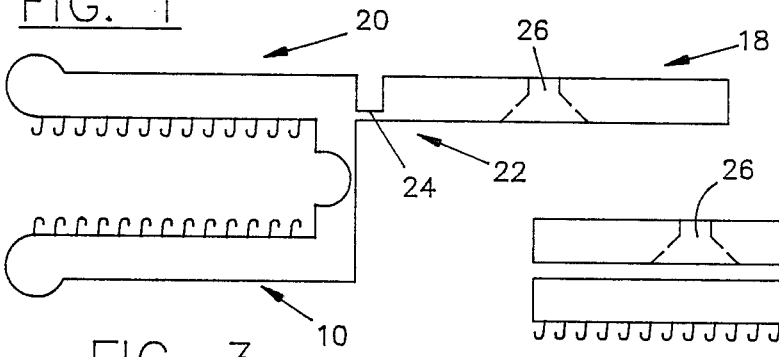
FIG. 3 is an end view of a unitary mounting and connecting member of the present invention according to one embodiment thereof.

The heart of the present invention is shown in one embodiment in FIG. 3 and comprises a mounting member 18 having a connecting member 20 attached thereto and adapted for pivoting about an axis for at least 90°. Such a unitary structure, generally indicated as 22, is shown in FIG. 3 as being of extruded plastic with the pivoting action being provided by a living hinge 24. While the unitary mounting/connecting structure 22 could be used to advantage in a horizontal orientation, such uses shall be left to the imagination and the emphasis of the example herein shall be directed to a vertical orientation to provide a vertical, stacked arrangement of components. The mounting member 18 is provided with a plurality of mounting holes 26 therethrough by means of which the structure 22 can be securely fastened to a wall, or the like. In light-weight applications, peel and stick adhesive strips as well known in the art could also be employed.

Figure 4:
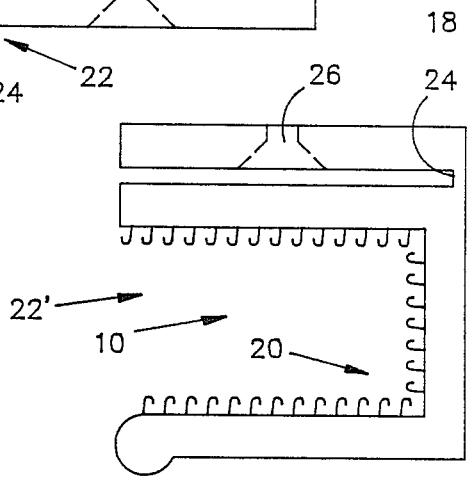
FIG. 4 is an end view of a unitary mounting and connecting member of the present invention according to one embodiment thereof.

An alternate embodiment of the unitary combined structure is shown in FIG. 4 and designated as 22'. In this instance, the connecting member 20 is adapted to fold over the mounting member 18 to hide the mounting holes 26. This structure is also adapted for heavier duty applications as the connecting member 20 is adapted to receive a thicker member (to be described shortly) therein. In both cases, the connecting member 20 includes a shear trap channel 10 as described above.

Figure 5:
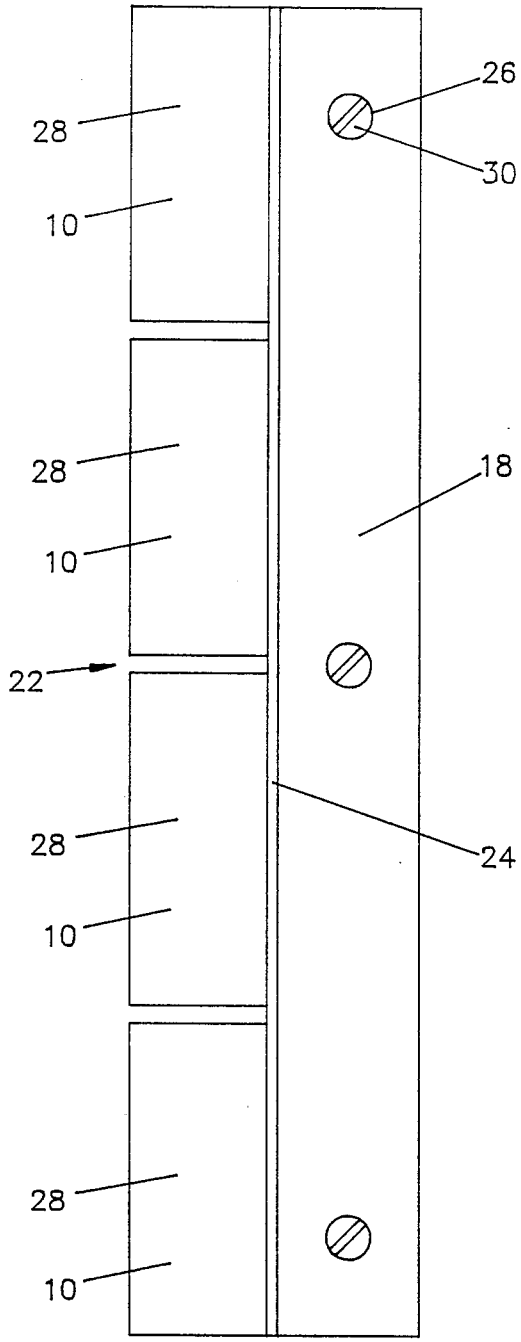
FIG. 5 is a front elevation view of the unitary mounting and connecting member of FIG. 3.
Figure 6:
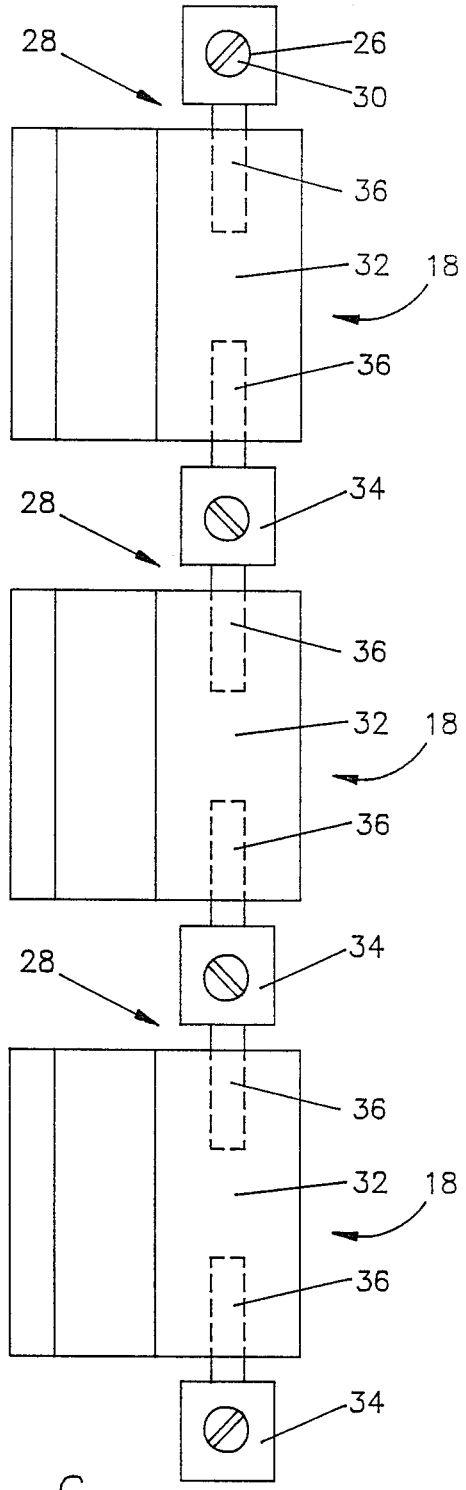
FIG. 6 is a front elevation view of non-unitary mounting and connecting members of the present invention in a third embodiment.

Turning now to FIGS. 5 and 6, another aspect of the present invention as well as a third embodiment of the mounting and connecting members will now be discussed. FIG. 5 is a front elevation view of the structure 22 of FIG. 3 and shows that the connecting member 20 is divided into a plurality of pivoting connectors 28 each of which includes a shear trap channel 10 which is pivotable about a vertical axis through the living hinges 24. The mounting member 18 is shown as being attached with screws 30 disposed through the mounting holes 26. FIG. 6 shows a more elaborate structure for the mounting and connecting member 18, 20. In this embodiment, the mounting member 18 comprises a plurality of connecting blocks 32 each attached to the wall, or the like, with screws 30 passing through mounting holes 26 provided therethrough for the purposes. The connecting blocks 32 are spaced apart and have mounting blocks 34 disposed therebetween mounted for pivotal movement on pivot pins 36. In this case, individual segments of shear trap channel 10 of the type shown in FIG. 2 are attached to the sides of the mounting blocks 34. As a result, each of the mounting blocks 34 and the shear trap channel attached thereto is pivotable about a vertical axis passing through the pivot pins 36.

Figure 8:
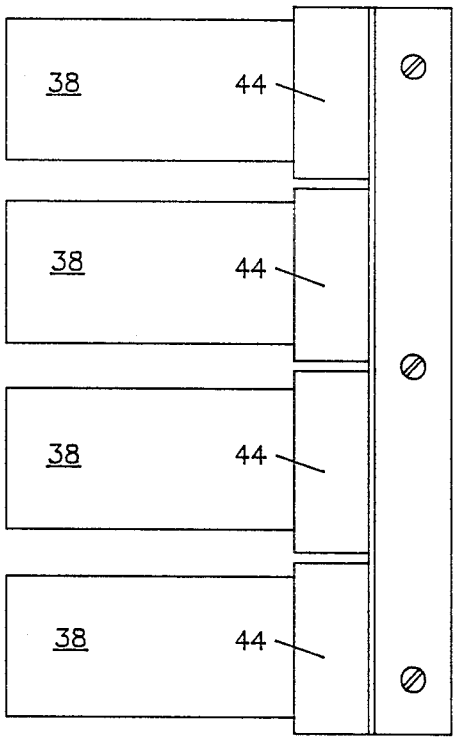
FIG. 8 is a front elevation view of the mounting and connecting member of FIG. 5 with a plurality of the drawers of FIG. 7 mounted therein.
Figure 9:
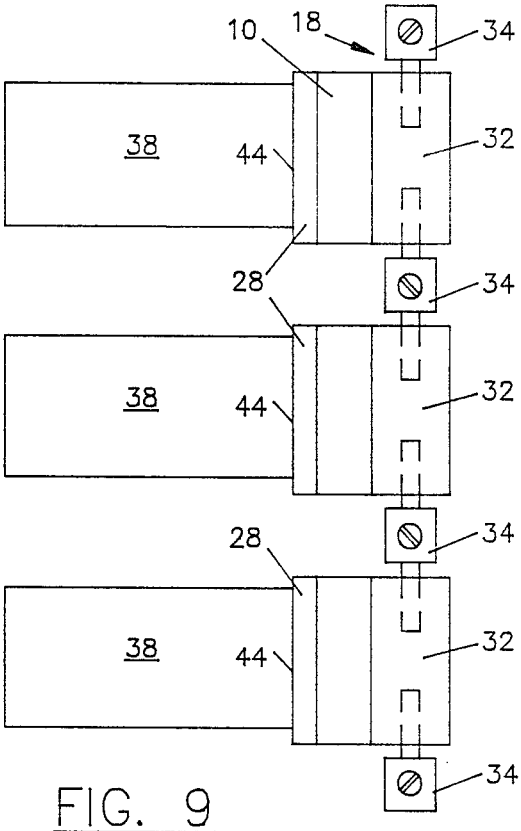
FIG. 9 is a front elevation view of the mounting and connecting members of FIG. 6 with a plurality of the drawers of FIG. 7 mounted therein.
Figure 7:
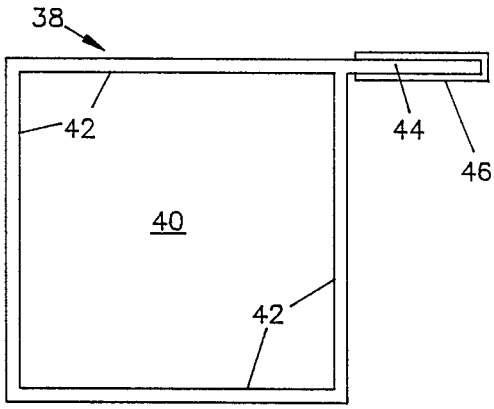
FIG. 7 is a plan view of a storage drawer according to the present invention adapted for releasable attachment to any of the three mounting and connecting members shown in the drawings.
Figure 10:
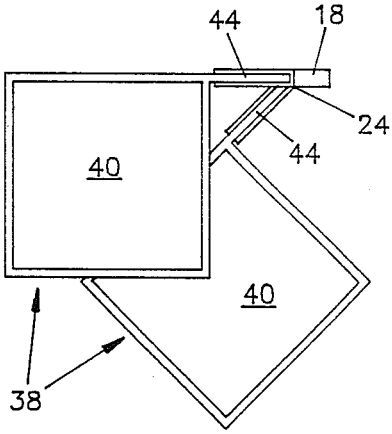
FIG. 10 is a top view of the apparatus of FIG. 8 showing one of the drawers pivoted about the vertical axis for access thereto.
Figure 11:
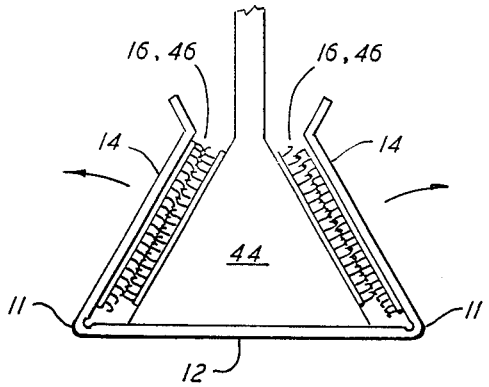
FIGS. 11 and 12 illustrate exemplary alternative cross-sections for the channels of FIGS. 1 and 2 with that of FIG. 11 adapted to engage a triangular cross-section fin and that of FIG. 12 having curved sides to engage a circular cross-section member. Reference numerals are consistent with FIGS. 1 and 2.
Figure 12:
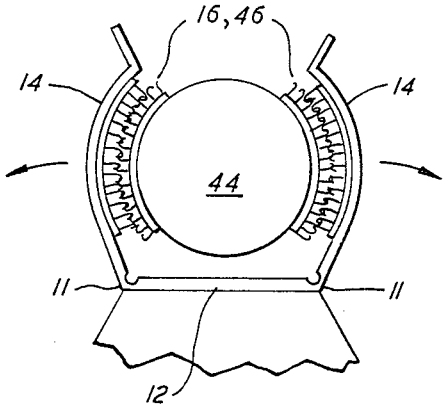

While many components could be releasably and pivotally carried by the connecting member 20, a drawer will be used as an example. The characteristics required for any component to be used with the above-described embodiments of a mounting and connecting members 18, 20 structure should be apparent to ones skilled in the art from such a single example. A sample drawer 38 is shown in plan view in FIG. 7. The drawer is rectangular in shape having a closed bottom 40 surrounded by planar sides 42. The top is open; but, could be provided with a hinged or removable lid if desired. A vertical fin 44 extends outward from one of the sides 42 in the plane thereof. This permits the drawer 38 to fit flush against a wall in the stacked or "closed" position. Other arrangements could, of course, be made to accomplish other purposes. The fin 44 has the loop portion 46 of hook and loop fastening material, such as that sold by the assignee of the present invention under the trademark Velcro, attached to the opposed outward facing surfaces thereof as with adhesive (not shown). FIGS. 8 and 9 show a plurality of the drawers 38 of FIG. 7 being held with the fins 44 gripped in the shear trap channels 10 thereof. FIG. 10 is a top view showing how individual drawers of the structure of FIG. 8 can be pivoted about their vertical axis so as to provide access thereto.

Thus, it can be seen that the apparatus of the present invention has met its desired purpose by providing a structure which is simple and easily adapted for varying applications. For inside closet applications, the only space occupied by the supporting structure is that of the mounting and connecting members 18, 20 which occupy only a strip where they are attached to the wall. The embodiments of FIGS. 3 and 4 can be easily provided in pre-established lengths and cut to length as required while the embodiment of FIG. 6 need only have as many mounting and connecting blocks 34, 32 stacked as necessary.

A touch fastener, as used in this application, comprises a first planar backing material having a surface carrying hooks, mushrooms, balls on stems, pigtails, or the like, capable of engaging loops, hooks, mushrooms, balls on steams, pigtails, or the like, carried by a second planar backing material to releasably fasten components together. Terms herein referring to hook and loop fastening systems and parts thereof shall be construed to include other types of touch fasteners in which the fastening strength in shear (i.e. against forces applied in the plane of the fastener) substantially exceeds the fastening strength resisting peeling separation of the fastener by the application of force normal to the plane thereof.

Wherefore, having thus described my invention, I claim:

1. A stacking, pivoting, wall storage unit with easily removable storage containers and the like, comprising:

(a) a vertical mounting member;

(b) a vertical connecting member hingedly carried by said mounting member for pivoting about a vertical axis, said connecting member including a plurality of vertically disposed shear trap channels each having a resiliently rigid back portion interconnecting a pair of resiliently rigid opposed side members defining inward facing surfaces with one of first and second portions of a touch fastening system thereon, said touch fastening system comprising said first portion carrying one of hooks, mushrooms, balls on stems, and pigtails capable of engaging one of loops, hooks, mushrooms, balls on stems, and pigtails carried by said second portion to releasably fasten the two portions together; and, (c) a plurality of stacking members each having a vertical rigid unitary planar fin member defining opposed outward facing surfaces extending therefrom and having the other of said first and second portions of the touch fastening system on the opposed outward facing surfaces whereby said stacking members can be releasably attached to said vertical connecting member when the touch fastening system engages in shear as said rigid unitary planar fin members are received between said inwardly facing surfaces of said shear trap channels, said back portion of each said channel member being of a width substantially equal to the thickness of the received fin member plus the other of said first and second portions of said touch fastening system such that said inwardly facing surfaces are substantially parallel to said outwardly facing surfaces and to each other upon in shear engagement of said touch fastening system, each shear trap channel having hinge means connecting at least one side member to said back portion and extending longitudinally along the length of the shear trap channel to permit said at least one side member to pivot outwardly in a manner to effect progressive disengagement of the touch fastening system when desired.

2. The wall storage unit of claim 1 wherein:

said stacking members are rectangular, open-topped boxes having said fin extending outward from a corner in the plane of a side thereof whereby when said boxes are attached to said vertical connecting member by fastening said fins in said shear trap channels said boxes can be individually pivoted between stacked relationship with one another and non-stacked relationship to allow access to individual boxes.

3. The wall storage unit of claim 1 wherein:

said vertical mounting member and said vertical connecting memer are of unitary construction and said hinged attachment of one to the other comprises a living hinge.

4. The wall storage unit of claim 3 wherein:

said vertical connecting member is adapted to fold over said vertical mounting member to hide the mounting member and act as a cover therefor.

5. The wall storage unit of claim 1 wherein:

(a) said vertical mounting member comprises a plurality of first block members adapted to be mounted to a wall or the like in vertical spaced relationship to one another; and (b) said vertical connecting member comprises a plurality of second block members adapted to pivotally mate with said first block members when disposed therebetween, said block members each having a U-shaped shear trap channel member vertically attached to one side thereof.

6. A supporting structure for a pivoting, wall storage unit with easily removable components, connected to the support structure by engaging first and second portions of a touch fastening system, said touch fastening system comprising said first portion carrying one of hooks, mushrooms, balls on stems, and pigtails capable of engaging one of loops, hooks, mushrooms, balls on stems and pigtails carried by said second portion to releasably fasten the two portions together, comprising:

(a) a mounting member adapted for mounting to a wall or the like, (b) a connecting member hingedly carried by said mounting member for pivoting about an axis, said connecting member including a plurality of shear trap channels each having a resiliently rigid back portion interconnecting a pair of opposed resiliently rigid planar members defining inwardly facing surfaces with one of said first and second portions of the touch fastening system thereon, and (c) a plurality of components each having a vertical rigid unitary fin member defining opposed outward facing surfaces extending therefrom and having the other of said first and second portions of the touch fastening system on the opposed outward facing surfaces, wherein each said shear trap channel is adapted to releasably receive a said rigid unitary fin member between said inwardly facing surfaces of said shear trap channel with the touch fastening system engaged in shear to thereby releasably support one of said plurality of components, said back portion of each said channel member being of a width substantially equal to the thickness of said received fin member plus the other of said first and second portions of the touch fastening system such that said inwardly facing surfaces are substantially parallel to said outwardly facing surfaces and to each other upon in shear engagement of said touch fastening system, said shear trap channel member having hinge means connecting at least one of said planar members to said back portion and extending longitudinally along the length of the shear trap channel to permit said at least one planar member to pivot outwardly in a manner to effect progressive disengagement of the touch fastening system when desired.

7. The supporting structure of claim 6 wherein:

said mounting member and said connecting member are of unitary construction and said hinged attachment of one to the other comprises a living hinge.

8. The supporting structure of claim 7 wherein:

said connecting member is adapted to fold over said mounting member to hide the mounting member and act as a cover therefor.

9. The supporting structure of claim 6 wherein:

(a) said mounting member comprises a plurality of first block members adapted to be mounted to a wall or the like in spaced relationship to one another; and, (b) said connecting member comprises a plurality of second block members adapted to pivotally mate with said first block members when disposed therebetween, said block members each having a U-shaped shear trap channel member attached to one side thereof.

10. A stacking, pivoting, wall storage unit with easily removable storage containers and the like, comprising:

(a) a vertical mounting member;

(b) a plurality of stacking members each having a vertically disposed shear trap channel having a resiliently rigid back portion interconnecting a pair of resiliently rigid opposed side members defining inward facing surfaces with one of first and second portions of a touch fastening system thereon, said touch fastening system comprising said first portion carrying one of hooks, mushrooms, balls on stems, and pigtails capable of engaging one of loops, hooks, mushrooms, balls on stems, and pigtails carried by said second portion to releasably fasten the two portions together; and, (c) a vertical connecting member hingedly carried by said mounting member for pivoting about a vertical axis, said connecting members including a plurality of vertical rigid unitary planar fin members defining opposed outward facing surfaces extending therefrom and having the other of said first and second portions of the touch fastening system on the opposed outward facing surfaces whereby said shear trap channels are adapted to releasably receive said rigid unitary planar fin members between said side members with said touch fastening system engaged in shear to releasably support said stacking members, said back portion of each said channel member being of a width equal to the thickness of said fin member plus the other of said first and second portions of said touch fastening system such that said inwardly and outwardly facing surfaces are all substantially parallel to one another upon engagement of said touch fastening system, said shear trap channel member having hinge means extending longitudinally along the length of the shear trap channel to permit at least one side member to pivot outwardly in a manner to effect progressive disengagement of the engaged touch fastening system.

11. In a touch fastening system comprising engaging first and second portions carried by first and second members, respectively, for releasable fastening the first and second members together, said touch fastening system comprising said first portion carrying one of hooks, mushrooms, balls on stems, and pigtails capable of engaging one of loops, hooks, mushrooms, balls on stems and pigtails carried by said second portion to releasably fasten the two portions together, the improvement characterized by:

(a) the first member carrying a shear trap channel having a resiliently rigid back portion interconnecting a pair of resiliently rigid opposed side members, defining inwardly facing surfaces, with one of said first and second portions of the touch fastening system on said inward facing surfaces, said shear trap channel member having at least one of its side portions connected to said back portions by hinge means; and (b) the second member carrying a rigid unitary fin member defining opposed outwardly facing surfaces and having the other of said first and second portions of the touch fastening system on its opposed outwardly facing surfaces, whereby said shear trap channel is capable of receiving said rigid unitary fin member between its inwardly facing surfaces with the first and second portions of the touch fastening system engaged in shear to releasably attach said second member to said first member, the rigid back portion is of a width substantially equal to the thickness of the rigid unitary fin member plus the other of said first and second portions such that the inwardly and outwardly facing surfaces are all substantially parallel to one another upon said in shear engagement, and said at least one hinged side portion provides progressive disengagement of the engaged touch fastening system when desired.

* * * * *